United States Patent [19]

Tennichi et al.

[11] Patent Number: 4,461,152

[45] Date of Patent: Jul. 24, 1984

[54] CONTROL APPARATUS FOR STEAM TURBINE

[75] Inventors: Yasuhiro Tennichi; Naganobu Honda, both of Hitachi, Japan

[73] Assignee: Hitachi, Ltd., Tokyo, Japan

[21] Appl. No.: 367,674

[22] Filed: Apr. 12, 1982

[30] Foreign Application Priority Data

Apr. 16, 1981 [JP] Japan ..... 56-56246

[51] Int. Cl.[3] ..... F01K 13/02

[52] U.S. Cl. ..... 60/660; 60/663

[58] Field of Search ..... 60/660, 662, 663, 664, 60/665, 667

[56] References Cited

U.S. PATENT DOCUMENTS

| | | | |
|---|---|---|---|
| 3,097,490 | 7/1963 | Callan et al. | 60/663 X |
| 3,802,189 | 4/1974 | Jenkins, Jr. | 60/665 |
| 3,896,623 | 7/1975 | Daniels | 60/665 |
| 4,184,337 | 1/1980 | Bloch | 60/660 |
| 4,203,297 | 5/1980 | Sakai | 60/660 |

*Primary Examiner*—Allen M. Ostrager

*Attorney, Agent, or Firm*—Antonelli, Terry & Wands

[57] ABSTRACT

In a steam turbine used with a power plant operated under variable pressure of the steam which is fed to the turbine through control valves, the control apparatus is arranged to control the control valves according to a signal obtained by adding an opening set signal with a compensation signal which is determined in dependence on a difference between a turbine stage steam pressure signal and a signal derived by multiplying the opening set signal with a ratio of the actual value of the control valve inlet steam pressure to a rated value thereof.

7 Claims, 4 Drawing Figures

CONTROL APPARATUS FOR STEAM TURBINE

The present invention relates to an apparatus for controlling a steam turbine, in which opening set signals for control valves provided at an inlet of the steam turbine are correctively modified according to a turbine stage steam pressure signal so as to control the turbine speed or load at a desired value. In particular, the invention concerns a steam turbine control apparatus for use with a thermal or heat power plant which incorporates therein the opening set signal correcting function mentioned above and, advantageously, a control apparatus suited for use in the control of such a steam turbine operated under variable steam pressure.

As is well known, a great difficulty is encountered in controlling an electric output power of a thermal power plant in compliance with power demands, because of a non-linear relationship between the opening of control valve and the steam flow thereof, that is, because the steam flow changes at a greater rate in a region of smaller opening degrees of the control valve, while the rate of change of the steam flow remains at low values in a region of greater opening degrees of the control valve.

In U.S. Pat. No. 3,097,488, two measures have been proposed for solving the above problem. According to one of the measures, a non-linear compensating function generator is provided in a control valve opening controlling loop to improve the relation between the opening set signal and the actual steam flow. While this measure has, in some cases certainly obviated the non-linearity, it is very difficult to determine the valve characteristics of all the control valves as used and establish the linearity for all the control valves to thereby operate satisfactorily in any different operation mode such as a full arc operation mode in which all of the control valves are operated, a partial arc mode where only some of the control valves are operated, or the like operation mode. According to the above U.S. patent unsatisfactory compensation for the non-linearity of the control valve is further compensated to improve the linearity by correctively modifying the opening set signal with a steam pressure signal derived from the high pressure turbine first stage. In other words, the U.S. patent basically relies on the fact that the turbine stage pressure is in a proportional relationship to the load and can operate with more rapid response than the latter. In order to apply the teaching of the U.S. patent to a turbine operating in the partial arc mode, it will be useful to employ a control system such as described in Japanese patent application No. 41967/76, laid-open No. 125904/77, Oct. 22, 1977. That is, the difference between the desired load and the turbine stage pressure due to the non-linearity of the control valve is introduced and the opening set signal is correctively modified by the difference signal so as to effectively establish the linearity even in the partial arc mode operation. In addition to the steam pressure of the high pressure turbine first stage, the pressure of the reheated steam may be used to the same end and effect, as it also represents the load. In the following description, these steam pressures will be commonly referred to as "turbine stage pressure".

The corrective modification or correction of the opening set signal by the turbine stage pressure signal is satisfactorily effective to compensate for the non-linearity when applied to a steam turbine of a thermal power plant operated under constant pressure. For example, it is assumed that the opening set signal has magnitude of 100 in an arbitrary unit but the magnitude of the load (turbine stage pressure) is only 90 due to the non-linearity of the control valve. Under these conditions, the magnitude of the load can be increased in approximation to 100 by modifying the opening set signal so as to be equal to 110, for example, with the aid of the turbine stage pressure signal.

By the way, there is recently a tendency that many thermal power plants supplying loads of intermediate magnitude adopt a so-called variable steam pressure operation system. It has been found that in the case of such thermal power plant, the compensation for the non-linearity of the control valve according to the turbine stage pressure F as mentioned above is not satisfactory. The reason for this is considered as follows. With a turbine load L, a control valve inlet steam pressure $P_F$, and an opening of the control valve is A, the following relationship applies:

$$L = A \cdot P_F \tag{1}$$

In the plant operation under constant pressure, the control valve inlet steam pressure $P_F$ is controlled to be constant at the side of a boiler, while the turbine load or output is controlled by regulating the opening of the control valve A. Since the control valve inlet pressure $P_F$ is substantially constant, the turbine stage pressure proportional to the load L is definitely determined in dependence on the opening of the control valve A. Consequently, the turbine stage pressure provides a measure for the opening of the control valve A and thus can be utilized for compensation for the non-linearity described above. However, in the case of the plant operation under variable pressure, the control valve inlet steam pressure $P_F$ is variable in dependence on the load on the side of the boiler. On the other hand, the opening of the control valve A is maintained as constant as possible except that the control valve is used for fine regulation or adjustment of the load. Under the circumstances, the turbine stage pressure, proportional to the load is determined in dependence on both the opening of the control valve A and the valve inlet steam pressure $P_F$. Thus, the detected value of the turbine stage pressure can not straightforwardly provide the measure for the valve opening. In other words, the turbine stage pressure can not effectively be used as the measure for the opening of the control valve without considering the valve inlet steam pressure $P_F$.

An object of the present invention is to provide a steam turbine control apparatus which incorporates an opening set signal correcting function and which can advantageously be used with a steam turbine in a power plant operated under variable steam pressure.

According to an aspect of the invention, a signal indicative of the control valve inlet steam pressure is used for correctively modifying the opening set signal for control valve adjustment in a steam turbine operated under variable steam pressure.

The above and other objects, features and advantages of the present invention will become more apparent from the following description of exemplary embodiments thereof taken in conjunction with the accompanying drawings, wherein FIG. 1 is a schematic view of a general arrangement of a thermal power plant provided with a turbine control apparatus;

Figure 1:
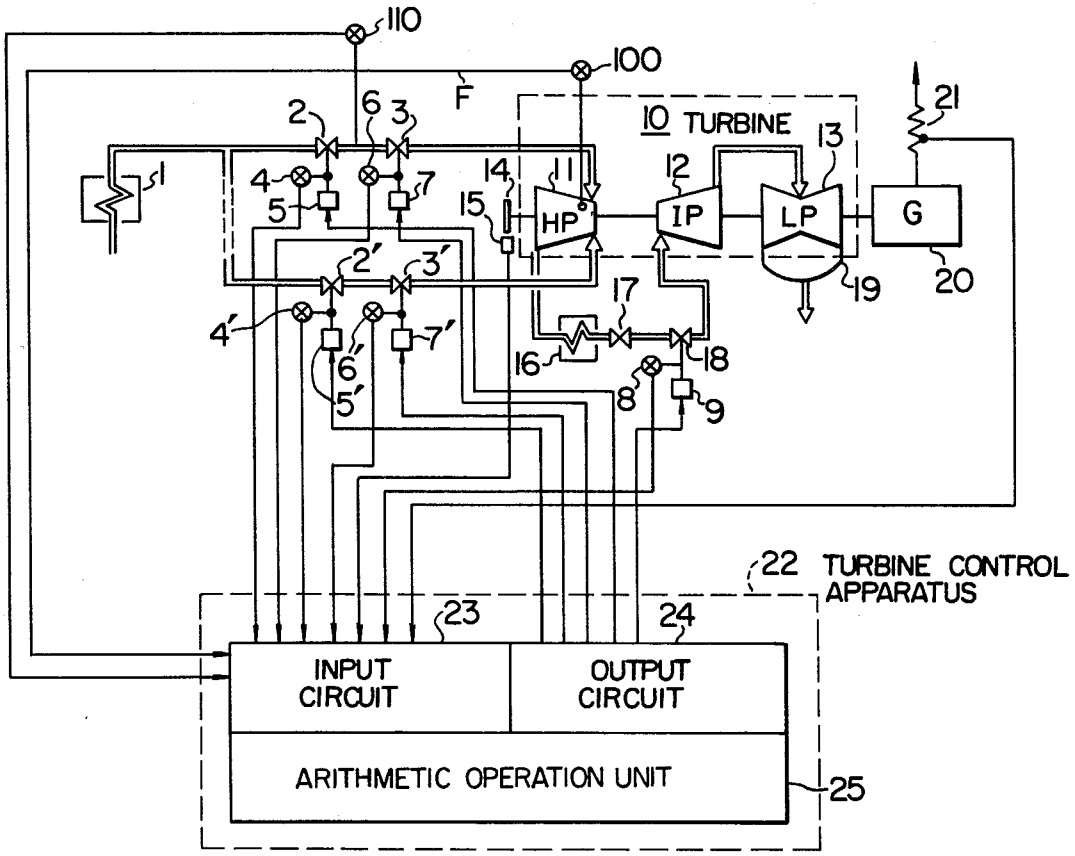

Referring now to the drawings wherein like reference numerals are used throughout the various views to designate like parts and, more particularly, to FIG. 1, according to this figure, in a turbine control system steam generated in a boiler 1 is supplied to a turbine 10 through main steam stop valves 2 and 2' and control valves 3 and 3'. The turbine 10 is usually composed of a high pressure turbine stage 11, an intermediate pressure turbine stage 12 and a low pressure turbine stage 13. The steam having done work at the high pressure turbine stage 11 flows into a reheater 16 to be raised again in temperature and is fed to the intermediate and low turbine stages 12 and 13 through a reheated steam stop valve 17 and an intercept valve 18. The steam having done work at the intermediate and low pressure turbine stages 12 and 13 is subsequently supplied to a condenser 19 to be condensed into water. Energy carried by the steam is converted by the turbine 10 into a mechanical energy for rotating an electric generator 20. The electric power generated by the electric generator 20 is supplied to a power transmission system. The turbine control system further includes valve position detectors 4, 4', 6, 6', and pressure detectors 100, 110. The output signals from these detectors are supplied to a turbine control apparatus 22 as inputs thereto. Further, the turbine control apparatus 22 has inputs receiving signals representative of a turbine rotational speed and a turbine load, respectively. The former signal is produced by a turbine speed detector 15 disposed near a toothed wheel 14 fixedly mounted on the turbine shaft for rotation therewith, while the turbine load signal is derived by a power transducer 21. All the detection signals mentioned above are fed to an arithmetic operation unit 25 through an input circuit 23. The arithmetic operation unit 25 serves to arithmetically determine, on the basis of the input information, a number of the valve positions of the valves such as the main steam stop valves 2 and 2', the control valves 3 and 3' and others for controlling correspondingly the rotational speed and the load of the turbine 10. Valve drive control signals thus determined are then supplied through an output circuit 24 to drive units 5 and 5' for the main steam stop valves 2 and 2', drive unit 5 and 5' for the control valves 3 and 3' and a drive unit 9 for the intercept valve 18 for thereby driving the associated valves to the positions commanded by the arithmetic operation unit 25. At that time, the movements of the these valves are sensed by the associated main steam stop valve position detectors 4 and 4', control valve position detectors 6 and 6' and the intercept valve position detector 8, respectively. The detection signals derived from these valve position detectors are fed back to the input circuit 23 of the turbine control apparatus 22 for stabilizing the valve positions. In this connection, it should be mentioned that the control of the boiler system for the operation under variable steam pressure may be implemented by adopting a suitable one of various known control systems. Further, since the variable pressure operation control itself does not constitute a material feature of the invention, detailed description thereof will be unnecessary.

Figure 2:
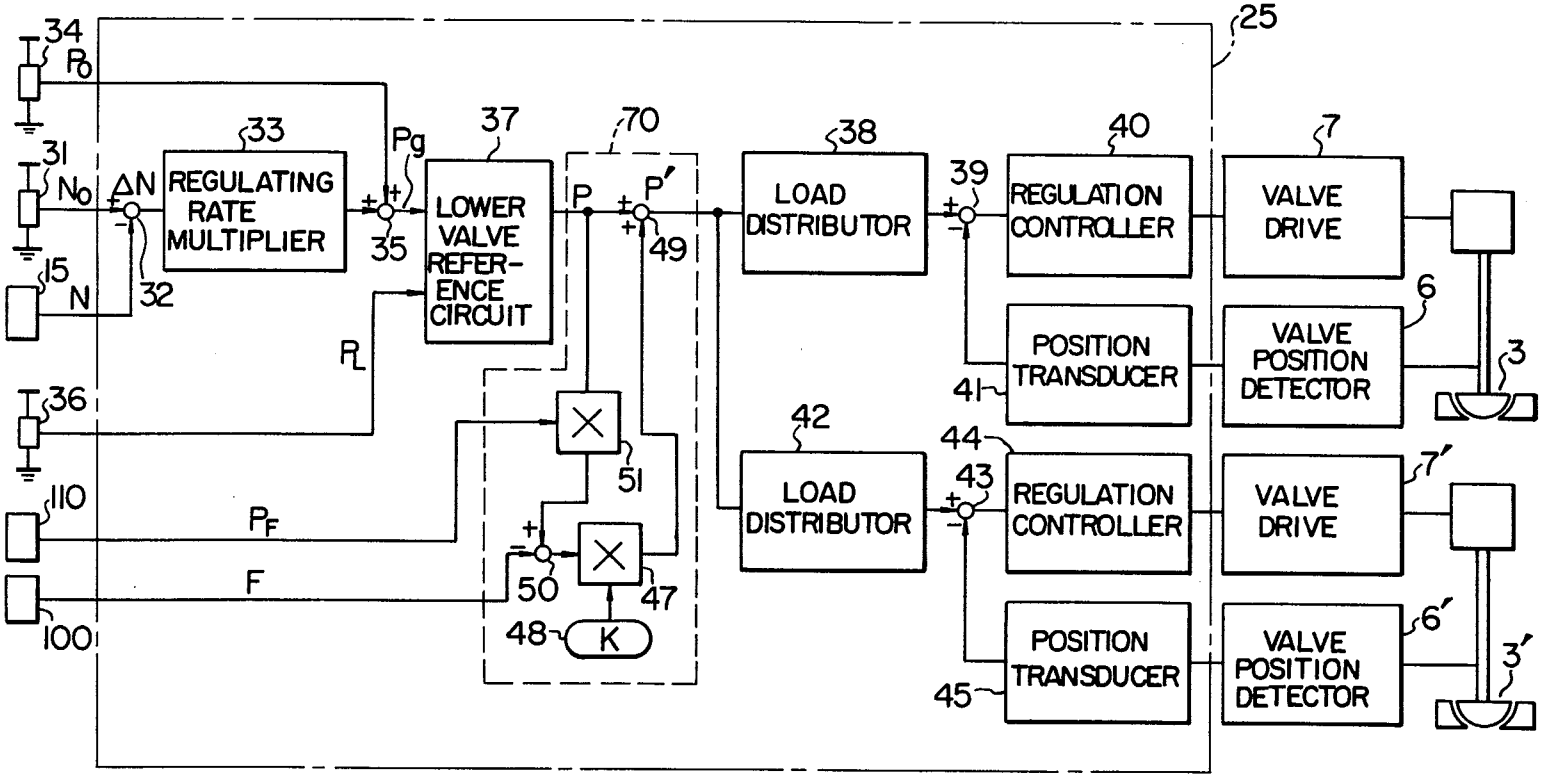
FIG. 2 is a block diagram showing a circuit arrangement of the turbine control apparatus for correcting an opening set signal P by a control valve inlet pressure $P_F$ according to an exemplary embodiment of the invention.

Although the operation unit 25 of FIG. 1 may be either analogue or digital, description herein will be made on the assumption that the operation unit 25 is implemented by using analog circuits. More particularly, as shown in FIG. 2, which shows only those components of the operation unit 25 of the control apparatus 22 relevant to the opening set signal correcting function, in a circuit arrangement for controlling the control valves 3 and 3' provided at the inlet side of the turbine 10, operation unit 25 is shown enclosed by a single-dotted broken line block. For the control of the control the signal representative of the actual rotational speed N of the turbine (outputted from the turbine rotation number detector 15) and the signals representative of the opening degrees of the control valves 3 and 3' (outputs of the position detectors 6 and 6') are supplied to the inputs of the arithmetic operation unit 25. Further, for the corrective modification of an opening set signal P, a high pressure turbine first stage pressure signal F (i.e. the output signal of a pressure detector 100) and a control valve inlet pressure signal M (i.e. the output signal of a pressure detector 110) are applied to the arithmetic operation unit 25. Additionally, a load limit signal $P_L$ for a load limiting operation (an output signal from a setting unit 36) and a set speed signal $N_o$ for a speed control (an output signal from a speed setting unit 31) are applied as the inputs to the arithmetic operation unit 25. In accordance with these input signals, the arithmetic operation unit 25 ultimately controls the operation of the valve drive units 7 and 7' for the control valves 3 and 3'.

For deriving the valve opening set signal P, the turbine rotational speed as detected by the speed detector 15 provides the actual rotational speed signal N which is compared through a comparator 32 with the set speed signal $N_o$ set at the speed setting unit 31. A deviation or difference signal $\Delta N = N_o - N$ produced from the output of the comparator 32 is transmitted to a regulating rate multiplier circuit 33 where the speed deviation or error $\Delta N$ is multiplied by a gain corresponding to a preset speed regulation rate $\delta$. The resultant product signal is supplied to an adder 35 where the product signal is added with the load reference signal $P_o$ set by the load setting unit 34, to thereby prepare a load signal $P_g$. The speed regulation rate $\delta$ represents a value such that the variation of load corresponds to its full load when the speed (which corresponds to the frequency of the power transmission system in case the generator is connected thereto and operated in synchronism therewith) is deviated from the set value (rated value) by the rate $\delta$ (%). For example, the regulation rate of 5% means that the 100% of load is changed when the speed is deviated by 5%. More particularly, when the system frequency (speed) is increased by 5% during operation under 100% of load, the load is restricted down to 0% in order to maintain the frequency stabilized. The load signal $P_g$ is compared with the load limit signal $P_L$ set by the load limiter 36 through a lower value preference circuit 37 which produces as the final load signal P either one of the load signal $P_g$ or the load limit signal $P_L$ that has a lower value than the other. The operation in which the load signal $P_g$ is selected by the low value preference circuit 37 with preference over the load limit signal $P_L$ is referred to the speed governing operation, while the operation in which the load limit signal $P_L$ is selected is referred to as the load limiting operation. It is this signal P that constitutes the opening degree set point signal. The signal P is modified by a modifier circuit 70 into a modified or corrected signal P'. Before describing the function of the modifier circuit 70, the control of the control valves 3 and 3' with the aid of the modified signal P' will be described hereinbelow.

The modified opening set signal P' is distributed through load distribution circuits 38 and 42 according to the operation mode of the turbine being applied at that time, thereby determining the steam flows in the valves and controlling the respective valve positions. The output signal from the load distribution circuit 38 is compared through a comparator 39 with the valve position feedback signal produced by a position transducer unit 41. The resulting difference signal is converted by a regulation controller 40 into a valve drive signal for regulating the control valve 3 through the valve drive unit 7. Movement or stroke of the control valve 3 is detected by the valve position detector 6 and fed back to the comparator 39 through the position transducer unit 41 to thereby control the valve position to be stable in a feedback control loop. Usually, there are provided a plurality of control valves. The other control valve 3' is also controlled in the similar manner. More specifically, the output of the above mentioned load distributor circuit 42 is compared with the valve position feedback signal produced from the position transducer 45 at the comparator 43. The difference signal thus obtained is converted into the valve drive signal by the regulation controller 44, which signal is then applied to the valve drive unit 7' to regulate the control valve 3'. The signal indicative of the movement of the control valve as detected by the position detector 6' is fed back to the comparator 43 through the position transducer 45 to thereby stabilize the regulated or controlled position of the valve 3'. In the valve drive mechanism described above, elements for compensating for non-linearity characteristics of the control valves may be incorporated in the load distribution circuits 38 and 42 or, alternatively, in the position transducers 41 and 45, although the non-linearity compensating elements are not illustrated. The load distributor circuits 38 and 42 serve for change-over of the turbine operation modes. For example, assuming that the modified opening set signal P' is in a range of 0–10 volts to be used for controlling the openings of four control valves $CV_1$, $CV_2$, $CV_3$ and $CV_4$ to thereby control the turbine operation, when the turbine operates in the full arc mode, the load distribution circuits 38 and 42 produces outputs of such values, with the signal P' of "0" volt, as causing all the control valves to be closed and with the signal P' of 10 volts, as causing all the valves to be full-open. Of course, the signal P' of intermediate value will cause the valves at the substantially same intermediate openings. On the other hand, when the turbine operates in the partial arc mode, the load distribution circuits produce outputs of such values as causing only the valve $CV_1$, with variation of the signal P' from "0" volt to 2.5 volts, to move from the closed position to the full-open position, and then causing the valve $CV_2$, with variation of the signal P' from 2.5 volts to 5.0 volts, to move from the closed position to the full-open position, and the valves $CV_3$ and $CV_4$, with variation of the signal P' from 0.5 to 7.5 volts and from 7.5 to 10.0 volts, respectively, to move from the closed position to the full-open position thereof. Consequently, with the signal P' of intermediate value, one of the control valves may be at intermediate opening, while the other control valves may be at the closed or fully-open positions.

Figure 3:
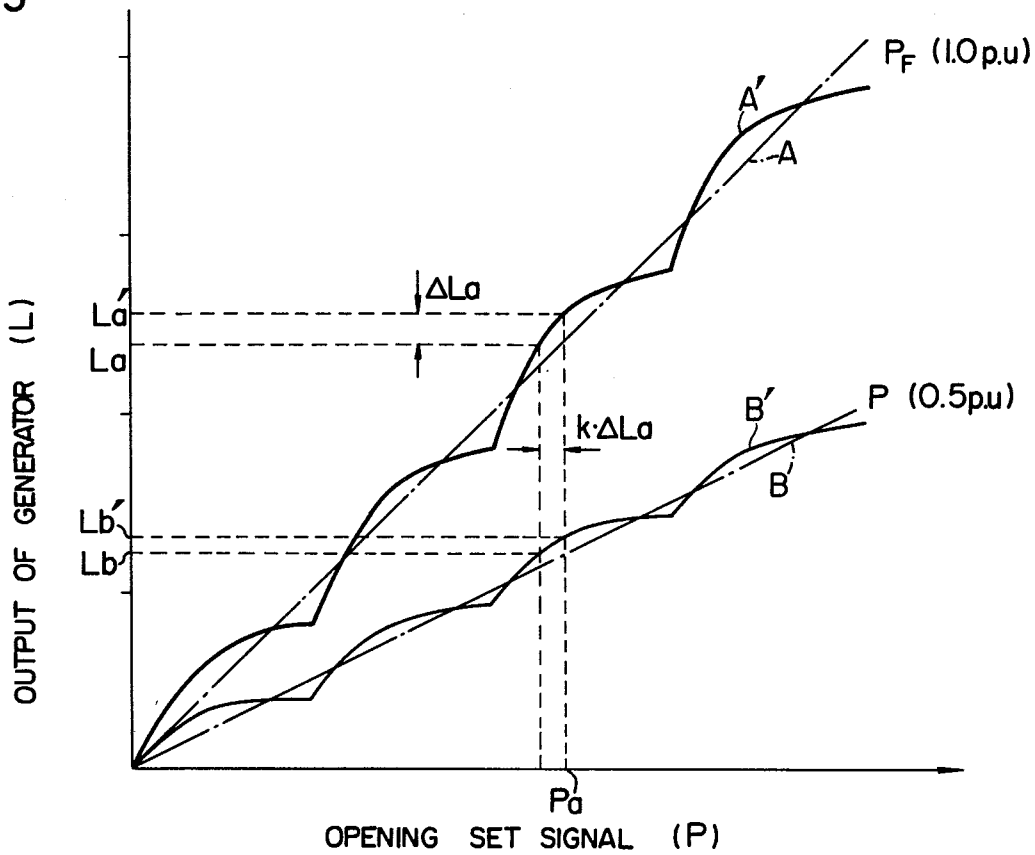
FIG. 3 is a view to graphically illustrate the principle of the invention.

For a better understanding of the invention, problems of the known system in which the multiplier 51 is absent will first be discussed in some detail. Referring to FIG. 3 which graphically illustrates relationships between the opening set signal P and the output power L of the electric generator, a curve A' represents the actual relationship at the rated pressure where $P_F$ is 1.0 percent unit or p.u. i.e. 100% of rated value and a curve A represents an ideal relationship or characteristic. When the opening set signal is set at a value $P_a$ (i.e. $P=P_a$), the load should ideally correspond to a value $L_a$ on the characteristic curve A. However, in reality, the load takes a value $L_a'$ on the characteristic curve A'. This load of the level $L_a'$ is detected as the turbine stage pressure F and subjected to subtraction with the opening set signal P at the subtraction circuit 50 included in the modifier circuit 70. Since the signal P is in proportion to the ideal output value $L_a$, the output signal from the subtraction circuit 50 corresponds to a difference $\Delta L_a$ (shown in FIG. 3). Thus, it is possible to attain the ideal output level $L_a$ by multiplying the load difference $\Delta L_a$ with a coefficient K, the resultant product signal $K \cdot \Delta L_a$ being added to the opening set signal P at an adder 49 to thereby obtain a modified opening set signal P' on the basis of which the valve control mentioned hereinbefore is carried out. However, in the case of the operation under variable steam pressure, the situations become different. In this case, the ideal relation ahd the actual relation are such as shown by characteristic curves B and B' in FIG. 3 which are depicted on the assumption that $P_F$ is 0.5 p.u. i.e. 50% of rated value. When the opening set signal P is set at a value $P_a$, the corresponding output is not at the level $L_b$ on the characteristic curve B but at $L_a$ on the characteristic curve A. For example, assuming that the signal $P_a$ of 5 (V) corresponds to the load $L_a$, the above applies valid regardless of $P_F$. On the other hand, the turbine stage pressure F corresponds to the load level $L_b'$. Thus, the correction for the case where $P_F=0.5$ p.u. is given by $K \cdot (L_a - L_b')$. The meaning of this correction is to open the control valve until the instant or actual output or load $L_b'$ coincides with the set signal $L_a$. Accordingly, the control valve is fully opened, as can be seen from the relation illustrated in FIG. 3. With such control, the operation can no more be said to be a variable pressure operation, since the steam pressure is rendered variable while the control valves are so controlled as to provide the opening as constant as possible, to thereby involve the possible highest efficiency. Thus, the full opening or closing of the control valves contradicts the principal purpose of the variable pressure turbine operation.

To deal with the problem mentioned above, it is proposed according to the invention that the opening set signal P be multiplied by a turbine stage pressure ratio signal $P_F$ in the modifier circuit 70 shown in FIG. 2. The signal $P_F$ represents the ratio of the instant or actual value of the turbine stage pressure to the rated value thereof. In the case of the turbine operation under the rated turbine pressure, the value of this ratio is 1.0 p.u., while in the operation under the pressure corresponding to a half of the rated turbine pressure, the value of $P_F$ is 0.5 p.u. Thus, in the turbine operation under the rated pressure, the output signal from the multiplier 51 is equal to the opening set signal P, because $P \times P_F = P \times 1.0 = P$. This output signal corresponds to the load level $L_a$. The quantity of correction is then given by $K(L_a-L_a')$, whereby the control is carried out until the output L of the electric generator attains the level $L_a$. In the case of the operation under the pressure corresponding to a half of the rated turbine pressure, the output signal from the multiplier 51 is equal to $\frac{1}{2}$ P, because $P\times P=P\times\frac{1}{2}=\frac{1}{2}$ P, which corresponds to $\frac{1}{2}$ $L_a=L_b$. In this case, the quantity of correction is given by $K(L_b-L_b')$. Thus, the control is made until the output L of the generator attains the level $L_b$. The circuit configuration shown in FIG. 2 allows the output of the electric generator to be obtained in accordance with the ideal characteristic curve as the function of the prevailing pressure and the valve opening by virtue of the feature that the opening set signal P is multiplied by the pressure ratio $P_F$ defined above. Thus, it is possible to obtain the predetermined output of the electric generator independent of the turbine inlet pressure. The correction system mentioned above is a proportionate type of automatic control loop and has a so-called offset error in the strict sense. For compensating for this offset error, there may be provided an integrator in addition to the setting unit 48 and the multiplier 47 to thereby constitute a proportional and integral control loop. In this connection, it should be mentioned that the correction of the valve position effected according to the invention is of a very small magnitude and does not adversely affect to the variable pressure operation.

Figure 4:
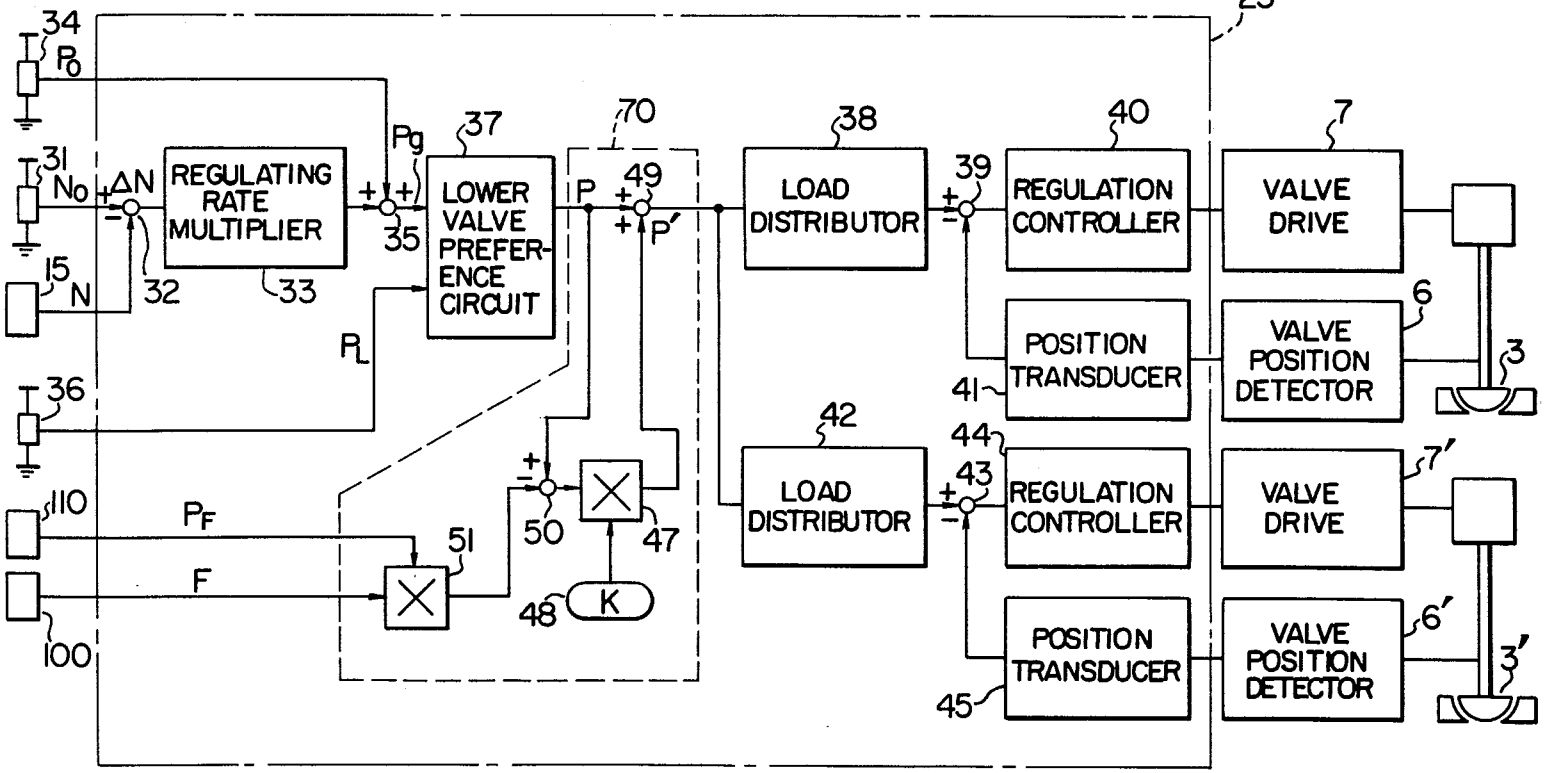
FIG. 4 is a block diagram of another embodiment of the turbine control apparatus according to the invention in which a turbine stage pressure F is adapted to be corrected by the control valve inlet pressure.

FIG. 4 shows another exemplary embodiment of the present invention which is so arranged that the turbine stage pressure F is corrected by the control valve inlet pressure $P_F$ instead of correcting the opening set signal P by the latter. In the case of this embodiment, the control valve inlet pressure is governed by the ratio of the rated value of the control valve inlet pressure to the instant value thereof (i.e. rated value of the control valve inlet pressure divided by the instant value of the control valve inlet pressure). Thus, at the rated pressure, the ratio $P_F$ is equal to 1.0, while the ratio $P_F$ is equal to 2.0 when the instant control valve inlet pressure is a half of the rated value thereof. Thus, in the operation state in which the control valve inlet pressure is a half of the rated value and the opening set signal P is set at the level $P_a$, the turbine stage pressure F is then equal to $L_b'$, the ratio $P_F$ defined above is equal to 2, and thus the output of the multiplier is $L_a'$, because $F\times P_F=2\times L_b'=L_a'$. On the other hand, since $P=L_a$, there is derived a difference $(L_a-L_a')$ from the output of the subtraction circuit 50, and the control is made until the difference is zero. The embodiment shown in FIG. 4 brings about advantages similar to those of the circuit shown in FIG. 2.

What is claimed is:

1. An apparatus for controlling a steam turbine of a thermal power plant operated under a variable steam pressure, the apparatus comprising means for detecting a turbine stage pressure and for supplying an output signal thereof, means for controlling an opening of control valve means provided at an inlet side of the steam turbine, means for detecting a steam pressure at the inlet side of said control valve means and for providing an output signal thereof, and means for receiving the output signals from said turbine stage pressure detecting means and said steam pressure detecting means and for providing a modified opening set signal to the controlling means whereby the opening of the control valve means is controlled on the basis of said turbine stage pressure and the steam pressure at the inlet of said control valve means.

2. A turbine control apparatus according to claim 1, wherein said means for detecting the turbine stage pressure is disposed so as to detect the pressure of steam discharged from a first stage high pressure turbine of said steam turbine.

3. A turbine control apparatus according to claim 1, further comprising means for reheating steam discharged from a high pressure turbine stage of said steam turbine.

4. An apparatus for controlling a steam turbine of a thermal power plant operated under a variable steam pressure, the apparatus comprising means for detecting an opening of control valve means provided at an inlet side of the steam turbine and providing an output signal thereof, means for detecting a turbine stage pressure and providing an output signal thereof, means for determining a compensation signal in dependence upon a difference between the output signals of the opening detecting means and the turbine stage pressure means, means for providing a modified opening set signal for controlling an opening of the control valve means in dependence upon the compensation signal; means for detecting a pressure prevailing at an inlet of the control valve means and for providing an output signal of a detected pressure; and means for receiving the output signals of the pressure prevailing at the inlet of the control valve means and for correctively modifying a magnitude of said compensation signal by the pressure of the steam prevailing at the inlet of said control valve means.

5. A turbine control apparatus according to claim 4, wherein said means for receiving and correctively modifying is adapted to multiply either said opening output signal or said turbine stage pressure output signal with a ratio between a rated value and an actual valve of the steam pressure at the inlet of the control valve means.

6. A turbine control apparatus according to claim 5, wherein the ratio with which said opening output signal is multiplied is a ratio of the actual value of the control valve inlet steam pressure to the rated value of the control valve inlet steam pressure.

7. A turbine control apparatus according to claim 5, wherein the ratio with which said opening signal is multiplied is a ratio of the rated value of the control valve inlet steam pressure to the actual value of said control valve inlet steam pressure.

* * * * *